US007836955B2

(12) United States Patent
Creighton

(10) Patent No.: US 7,836,955 B2
(45) Date of Patent: Nov. 23, 2010

(54) WIRELINE BAILING SYSTEM FOR REMOVING LARGE VOLUMES OF LIQUID FROM A BOREHOLE

(75) Inventor: John Leith Creighton, Aberdeen (GB)

(73) Assignee: Precision Energy Services, Inc., Fort Worth, TX (US)

( * ) Notice: Subject to any disclaimer, the term of this patent is extended or adjusted under 35 U.S.C. 154(b) by 187 days.

(21) Appl. No.: 11/695,120

(22) Filed: Apr. 2, 2007

(65) Prior Publication Data

US 2008/0236834 A1 Oct. 2, 2008

(51) Int. Cl.
*B21B 37/00* (2006.01)

(52) U.S. Cl. ..... 166/311; 166/107

(58) Field of Classification Search ..... 166/311, 166/105, 105.1–105.4, 107
See application file for complete search history.

(56) References Cited

U.S. PATENT DOCUMENTS

| | | | | | |
|---|---|---|---|---|---|
| 2,099,877 | A | | 11/1937 | Westall | |
| 2,141,672 | A | | 12/1938 | Taylor | |
| 2,925,866 | A | * | 2/1960 | Arterbury | 166/163 |
| 3,294,170 | A | * | 12/1966 | Warren et al. | 166/100 |
| 3,474,737 | A | * | 10/1969 | Norman et al. | 417/53 |
| 3,650,325 | A | * | 3/1972 | Owens | 166/182 |
| 4,037,662 | A | * | 7/1977 | Bowling | 166/311 |
| 4,190,113 | A | | 2/1980 | Harrison | |
| 4,493,383 | A | * | 1/1985 | Williams et al. | 175/234 |
| 4,621,693 | A | | 11/1986 | Caldwell et al. | |
| 4,711,299 | A | | 12/1987 | Caldwell et al. | |
| 5,139,089 | A | * | 8/1992 | Wacker | 166/311 |
| 5,147,149 | A | * | 9/1992 | Craig et al. | 405/223.1 |
| 5,167,278 | A | * | 12/1992 | Goldschild | 166/113 |
| 5,558,153 | A | * | 9/1996 | Holcombe et al. | 166/373 |
| 6,059,042 | A | * | 5/2000 | Huber et al. | 166/377 |
| 6,196,319 | B1 | * | 3/2001 | Henskens et al. | 166/311 |
| 6,220,347 | B1 | * | 4/2001 | Head | 166/105.3 |
| 6,460,622 | B1 | * | 10/2002 | Rice | 166/369 |

(Continued)

OTHER PUBLICATIONS

Examination Report dated Jul. 22, 2009 from Intellectual Property Office, UK Patent Application No. GB0804324.2; 1 Page.

(Continued)

*Primary Examiner*—Daniel P Stephenson
*Assistant Examiner*—Blake Michener
(74) *Attorney, Agent, or Firm*—Wong, Cabello, Lutsch, Rutherford & Brucculeri,LLP

(57) ABSTRACT

An electrical wireline conveyed baling system for removing large volumes of liquids from a well borehole with a single trip of a bailer tool string. The system also utilizes one or more blow out preventers thereby allowing wireline bailing operations to be carried out while controlling well pressure. A bailer tool string that is conveyed by the wireline comprises a tool head containing a pump, at least one carrier section, and a no-return valve. Once deployed in the borehole, a first signal transmitted via the wireline from the surface activates the pump thereby reducing pressure within the carrier section. A second signal transmitted via the wireline from the surface opens the no-return valve thereby allowing liquid to flow from the borehole into the carrier section. The bailer tool string containing liquid is subsequently retrieved via the wireline thereby removing liquid from the borehole. A plurality of carrier sections can be axially stacked and deployed thereby increasing liquid bailing capacity while still maintaining well pressure control.

15 Claims, 3 Drawing Sheets

U.S. PATENT DOCUMENTS

| | | | | |
|---|---|---|---|---|
| 6,719,050 | B2 * | 4/2004 | Longacre | 166/265 |
| 6,811,382 | B2 * | 11/2004 | Buchanan et al. | 417/244 |
| 6,851,476 | B2 * | 2/2005 | Gray et al. | 166/301 |
| 7,174,957 | B1 | 2/2007 | Jokhio | |
| 2003/0034161 | A1 | 2/2003 | Rice | |
| 2008/0115927 | A1 * | 5/2008 | Unsgaard | 166/105 |

OTHER PUBLICATIONS

Combined Search and Examination Report under Sections 17 & 18(3) dated May 29, 2008 from Intellectual Property Office, UK Patent Application No. GB0804324.2; 2 pages.

Search Report under Section 17 dated May 28, 2008 from Intellectual Property Office, UK Patent Application No. GB0804324.2; 1 page.

* cited by examiner

WIRELINE BAILING SYSTEM FOR REMOVING LARGE VOLUMES OF LIQUID FROM A BOREHOLE

This invention is directed toward hydrocarbon production, and more particularly toward the removal of large volumes of liquids from well boreholes to optimize the production of hydrocarbons from the well borehole. Liquid is removed using a wireline operated bailing system. Well pressure is controlled during the bailing operation.

BACKGROUND OF THE INVENTION

The borehole of a hydrocarbon producing well typically contains fluid comprising a liquid fraction. This liquid fraction may originate from one or more earth formations penetrated by the well borehole. Alternately, the liquid fraction may be drilling fluid or drilling "mud" used in the drilling operation to lubricate the drill bit, to remove drill cuttings from the well, and to control formation pressures that might be encountered in drilling. Liquid may also be added to the well borehole in production intervention operations.

Although sometimes beneficial, borehole liquid can be detrimental to hydrocarbon production. As an example, the borehole of a gas producing well may contain a liquid that has either been placed within the borehole operational purposes such as pressure control. Alternately, the gas well may also be producing a liquid fraction thereby creating a liquid loading situation within the borehole. Regardless of the origin, pressure exerted by borehole liquid can hinder or even terminate or "kill" the production of the desired gas phase.

Various techniques can be used to remove liquid from a well borehole. Perhaps the earliest technique involves "bailing" liquid from the borehole by sequentially lowering, retrieving, and dumping at the surface an open bailer container using a cable as a means for conveying the bailer container. The amount of liquid removed per sequence or "trip" of the bailer container is limited by the relatively small capacity of the container. Furthermore, bailing with an open bailer container provides no means for pressure control. If the well presents potential pressure problems, suitable surface pressure control equipment, such as blow out preventer, is required. Liquid removal using coiled tubing methodology allows well pressures to be controlled. The mobilization and deployment of coil tubing apparatus is, however, time consuming and costly. Time and cost are especially significant for offshore wells where a dedicated barge is required for a coiled tubing operation if there is insufficient deck space on a wellhead platform.

SUMMARY OF THE INVENTION

The present invention is a system for removing or "bailing" large volumes of liquids from a well borehole with a single trip of a bailer tool string. The bailer tool string is conveyed in and out of the borehole by means of a conventional electrical wireline thereby negating the need for special conveyance equipment such as coiled tubing systems. The system also utilizes one or more blow out preventers (BOP) thereby allowing wireline bailing operations to be carried out while controlling well pressure.

The bailer tool string comprises a tool head with an upper end operationally connected to a lower end of an electrical wireline, and a lower end operationally connected to a carrier section. The carrier section comprises a preferably cylindrical carrier container and a two-element deployment connector. The carrier container is terminated at an upper end by a first deployment connector element and terminated at a lower end by a second deployment connector element. The second deployment connector element is operationally connected to a non-return valve that allows liquid to flow into the carrier container from the borehole, but prevents liquid from flowing out of the carrier container into the borehole.

An electric pump is disposed within the tool head and electrically connected to equipment at the surface of the earth via the electrical wireline. The pump is also hydraulically connected to the carrier container of the carrier section through the deployment connector. Once deployed within the well borehole, the electric pump is activated by a signal from the surface. The action of the pump evacuates the carrier container. Upon completion of the pumping operation, the non-return valve is activated allowing liquid, which is at borehole pressure, to flow into the carrier container. Liquid is retained within the carrier container of the carrier section. Borehole liquid is, therefore, removed from the borehole by filling the carrier container of the carrier section and subsequently conveying the carrier section to the surface, via the wireline, where the liquid is purged.

Carrier sections can be axially connected or "stacked" by operationally connecting one to another by means of the deployment connectors. The number of stacked carrier sections proportionally increases the borehole liquid bailing capacity per trip of the bailer tool string in and out of the borehole.

The bailer tool string is configured at the surface using a deployment BOP system disposed near the well head of the borehole. The deployment BOP system along with a cooperating wireline BOP system allows the bailing system to be configured, deployed and retrieved from the borehole while maintaining borehole pressure control.

BRIEF DESCRIPTION OF THE DRAWINGS

So that the manner in which the above recited features, advantages and objects the present invention are obtained and can be understood in detail, more particular description of the invention, briefly summarized above, may be had by reference to the embodiments thereof which are illustrated in the appended drawings.

DETAILED DESCRIPTION OF THE PREFERRED EMBODIMENTS

The present invention is a wireline conveyed system for bailing large volumes of liquids from a well borehole with a single trip of a bailer tool string. Well borehole pressure is controlled during deployment and removal of the bailer tool string. Elements and principles of operation of the bailer tool string will first be disclosed. Apparatus and methods for deploying the bailer tool string into a borehole, and for subsequent removal of the tool string from the borehole, will be disclosed in a second section.

The Bailer Tool String

Figure 1:
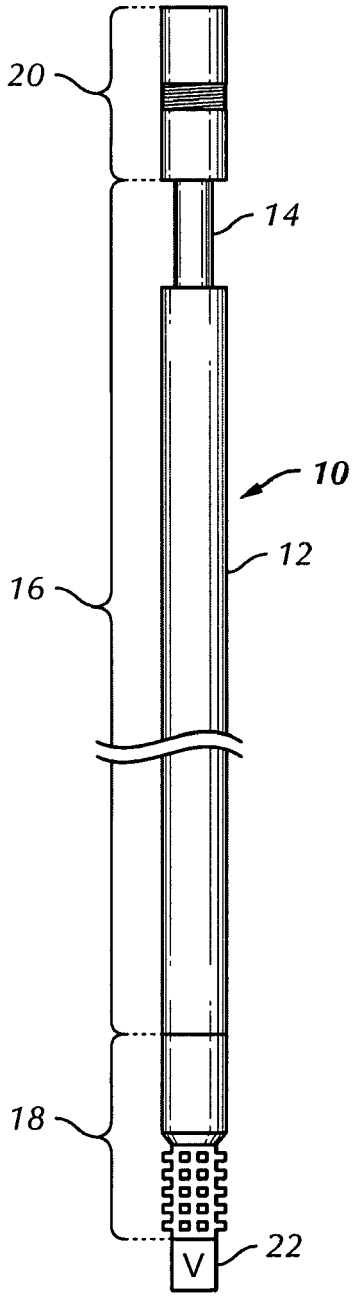
FIG. 1 illustrates major elements of a carrier section.

FIG. 1 illustrates a carrier section designated as a whole by the numeral 10. The carrier section 10 comprises a preferably cylindrical carrier container 12 with a "no-go" cylindrical recess or shoulder 14 on the outer surface of the carrier container. The function of the no-go shoulder 14 will be come apparent in subsequent sections of this disclosure. The length of the carrier section 10 is preferably 10 to 20 feet (3.05 to 6.10 meters) depending on the distance between an upper gate valve and a wireline BOP used to deploy the system (see FIG. 3). The diameter of the carrier section 12 is selected considering any well bore restrictions that the carrier section may encounter. The carrier section 12 of length 16 is terminated at an upper end by a first deployment connector element 20 and terminated at a lower end by a second deployment connector element 18. The second deployment connector element is operationally connected to a non-return valve 22 that allows liquid to flow into the carrier 12, but prevents liquid from flowing out of the carrier. A suitable connector is a Safeconn Deployment Connector manufactured by Texas Oil Tools, Conroe, Texas U.S.A. The overall length of this connector is about 1.5 feet (0.45 meters). The non-return valve 22 can be a flapper valve, a ball valve, or any other suitable valve type that provides one way liquid flow. Preferably the valve 22 cooperates with a filter (not shown) to ensure that debris is not drawn into the carrier 12 or the non-return valve 22.

The bailer tool string comprises a tool head with an upper end operationally connected to an electrical wireline and a lower end operationally connected to at least one carrier section 10. Within the context of this disclosure, the term "operationally connection" includes mechanical connection, electrical connection and hydraulic connection. It is preferred to connect or "stacked" a plurality of carrier sections 10 with carrier containers 12 in hydraulic communication or "hydraulically connected" with one to another by means of the deployment connector elements 18 and 20. Assuming that each carrier section 10 has the same liquid capacity, the liquid bailing capacity per trip of the bailer tool string in and out of the borehole is directly proportional to the number of stacked carrier sections 10.

Figure 2:
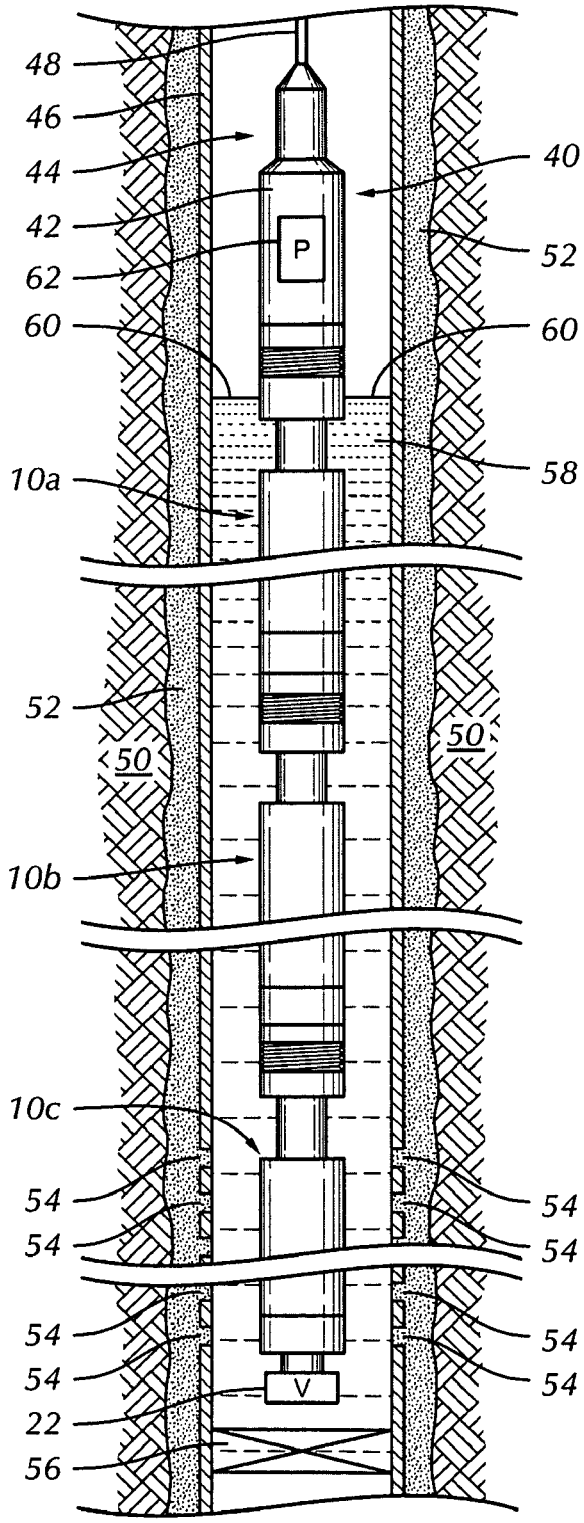
FIG. 2 illustrates a bailer tool string comprising a tool head, a no-return valve, and three stacked carrier sections.

FIG. 2 illustrates a bailer tool string 40 comprising a tool head 42 and three stacked carrier sections 10*a*, 10*b*, and 10*c*. A tool string comprising three stacked carrier sections will be used to illustrate the deployment and operation of the bailer tool string. It is emphasized that only a single carrier section can be used, or a stack of twenty, thirty or even more carrier sections can be deployed depending upon operational requirements and limitations of the liquid bailing operation. A non-return valve 22 is shown disposed on the lower end of carrier section 10*c*. The bailer tool string 40 is shown suspended within a borehole 44 by a wireline 48 comprising at least one electrical conductor. A lower end of the wireline 48 connected to the top of the tool head 42 and an upper end connected to draw works at the surface of the earth (see FIG. 3). The borehole penetrates earth formation 50 and is lined with casing 46 set in a cement annulus 52. The casing contains perforations 54 with a seal 56 such as a packer being set below the perforations. Formation fluid containing liquid 58 can enter the borehole 44 through the perforations 54. Alternately, liquid can be disposed in the borehole from the surface to serve as a pressure control weighting material, or disposed in the borehole during intervention pressure surface tests. As the level 60 of the liquid 58 rises, hydrostatic pressure at the perforations 54 increases thereby limiting or even terminating production of fluid through the perforations. In order to reduce hydrostatic pressure, liquid 58 is removed from the borehole 44 by means of the bailer tool string 40.

Again referring to FIG. 2, an electric pump 62 is disposed within the tool head 42 and is electrically connected to surface equipment (see FIG. 3) via the wireline 48 and cooperating wireline draw works. The pump 62 is also hydraulically connected to the carrier container 12 of each stacked carrier section 10*a*, 10*b* and 10*c* through the cooperating pairs of first and second deployment connector elements 18 and 20 disposed on each carrier section (see FIG. 1). Once the bailer tool string 40 is deployed within the borehole 44, the electric pump 62 is activated preferably by a "pump" signal transmitted from the surface equipment with the wireline 48 serving as an electrical conduit for the pump signal. The activated pump 62 then creates a pressure differential by evacuating the stacked and hydraulically connected carrier containers of the carrier sections 10*a*, 10*b* and 10*c*. Upon completion of the pumping operation, the non-return valve 22 is opened, again preferably by a "valve" signal from the surface equipment, thereby allowing liquid 58 to flow from the borehole 44 into the carrier containers of the carrier sections 10*a*, 10*b* and 10*c*. Alternately, the non-return valve 22 can be opened via the valve signal during pumping operations thereby allowing liquid 58 to flow from the borehole into the carrier containers of the stacked carrier sections. Once liquid enters the carrier containers, it is retained and can not return to the borehole 44 through the non-return valve 22. Borehole liquid 58 is, therefore, removed by filling the carrier containers of the carrier sections 10*a*, 10*b* and 10*c* and subsequently conveying the bailer tool string 40 to the surface, via the wireline 48, where the liquid is purged from the tool string.

Deployment of the Bailer Tool String

Figure 3:
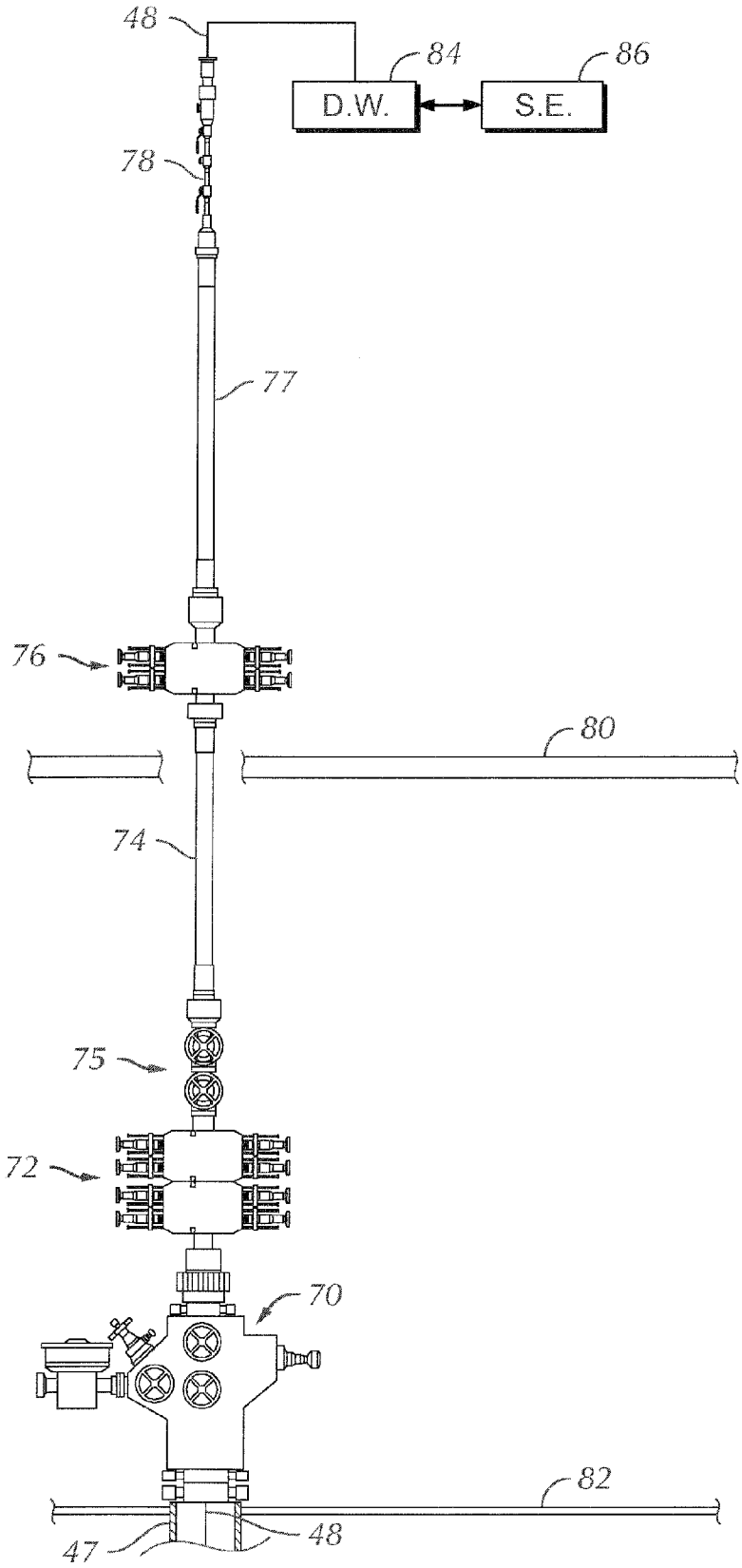
FIG. 3 illustrates surface apparatus required to deploy and operate a bailer tool string.

FIG. 3 illustrates surface apparatus required to deploy and operate a bailer tool string 40 (see FIG. 2) in a well borehole. Surface apparatus is shown configured for use on an offshore platform. It will be understood that disposition of the various elements of the surface apparatus can be reconfigured for use with onshore wells.

Again referring to FIG. 3, a wellhead assembly 70 is disposed on a well deck 82. The lower end of the well head 70 operationally connects to the well casing 46 (see FIG. 2) via a riser 47. A deployment BOP system 72 is operationally connected to the upper end of the wellhead assembly 70. A deployment BOP system 72 suitable for use with the bailer tool string 40 (see FIG. 2) is a Varco/Texas Oil Tool Deployment BOP System manufactured by Texas Oil Tools, Conroe, Texas U.S.A. The deployment BOP system 72 is operationally connected to a wireline BOP system 76 through two gate valves 75 and a riser 74 that passes through an impact deck 80. The wireline BOP system 76 is topped with a wireline lubricator 77 and grease injector head 78. The wireline 48, with a lower end operationally attached to the bailer tool string 40 at the tool head 42, traverses the well borehole 44, the riser 47, the well head 70, the BOP deployment system 72, the gate valves 75, the riser 74, the wireline BOP system 76, the lubricator 77, and emerges at the grease injector head 78. The upper end of the wireline terminates at a wireline draw works 84. The wireline draw works 84, which typically comprise two sheave wheels and a power winch, is well known in the art and is therefore illustrated conceptually in FIG. 3 by the box 84. The wireline 48 is electrically connected to surface equipment 86 typically through slip rings in the winch of the draw works 84. The surface equipment 86 comprises one or more power sources and cooperating circuitry to generate the previously discussed pump signal that activates the pump 62 and valve signal that opens the non-return valve 22 (see FIG. 2).

Referring to both FIGS. 1 and 3, the length 16 of the carrier section 10 is limited by the distance between an upper valve of the gate valves 75 and a wireline BOP system 76 as will be seen in a subsequent section of this disclosure. In practice, this distance limits the carrier length to about 10 to 20 feet (3.05 to 6.10 meters).

The previously described surface apparatus along with the following operational sequences permit the bailer tool string 40 to be configured with stacked carrier sections 10*a*, 10*b*, 10*c*, etc., deployed within the well borehole, and subsequently removed from the well borehole while maintaining well pressure control.

The following referenced Figures are cross sectional views of the deployment BOP system 72 illustrating only right side in detail, with the symmetrical left side being abbreviated for clarity and brevity. Furthermore, all axial bailer tool string movements and all tension and pull tests are performed by the operationally attached wireline 48 cooperating with the draw works 84.

Figure 4A:
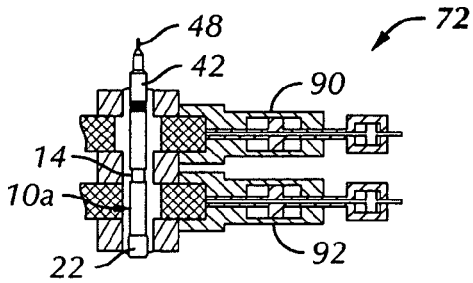
FIG. 4A shows a bailer tool string comprising a single carrier section disposed in the deployment BOP system with both guide and no-go rams open.

Using the wireline 48 cooperating with the draw works 84, the bailer tool string 40 comprising a first carrier section 10*a* with the tool head 42 and non-return valve 22 operationally attached to the upper and lower ends, respectively, is lowered into the deployment BOP system 72 as shown in FIG. 4A. Both guide and no-go rams 90 and 92, respectively, are open.

The tool string 40 is lowered further using the wireline 48 so that the no-go shoulder 14 of the carrier section 10*a* is axially aligned with the no-go rams 92. The no-go rams 92 are then closed engaging and gripping the carrier section 10*a* at the no-go shoulder 14. This step is illustrated in FIG. 4B.

Figure 4E:
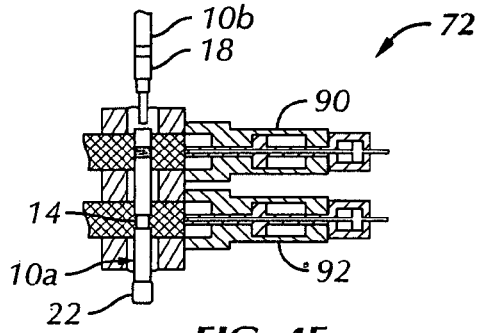
FIG. 4E illustrates the first step in stacking a second carrier section in the bailer tool string.
Figure 4B:
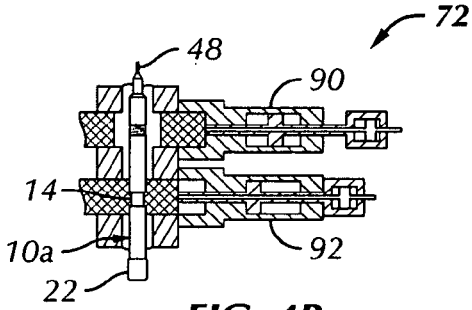
FIG. 4B shows the bailer tool string positioned so that the no-go shoulder of the carrier section is axially aligned with the no-go rams, and the no-go rams are closed contacting the carrier section at the no-go shoulder.
Figure 4F:
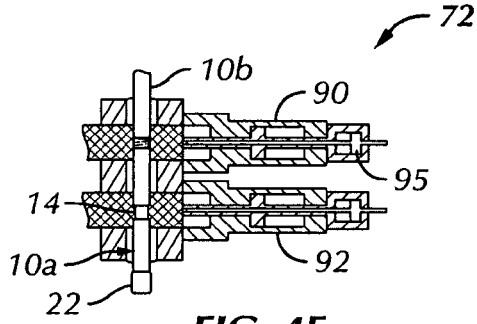
FIG. 4F shows a second carrier section connected to the first the carrier section and disposed in the deployment BOP system for a pull test.
Figure 4C:
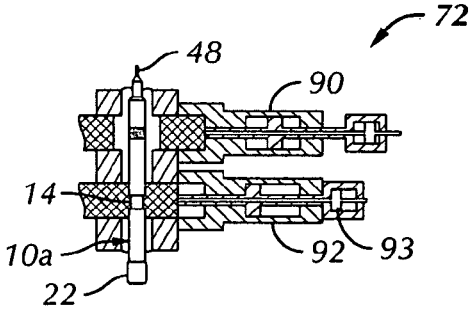
FIG. 4C shows the locks of the no-go rams closed while a pull test is performed.

The locks 93 of the no-go rams 92 are closed as illustrated in FIG. 4C, and a pull test is performed using the draw works and cooperating wireline.

Figure 4G:
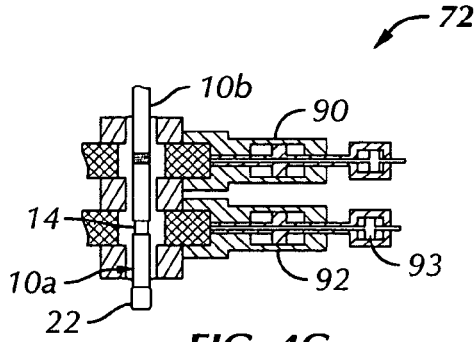
FIG. 4G illustrates the stacked bailer tool disposed in the deployment BOP system with guide and no-go rams open.
Figure 4D:
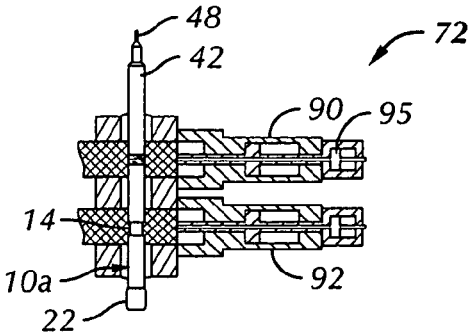
FIG. 4D shows the guide rams close and contacting the upper end of the carrier section with the tool head released.

While holding tension, the guide rams 90 are close to engage and grip the upper end of the carrier section 10*a*, the locks 91 of the guide rams are closed, tension is released, and the tool head 42 is released. This step is illustrated in FIG. 4D.

FIG. 4E illustrates the first step in stacking a second carrier section 10*b* in the bailer tool string 40. With both the guide rams 90 and the no-go rams 92 closed and locked, the second deployment connector 18 of the second carrier section 10*b* is radially aligned with the first deployment connector element 20 of the carrier section 10*a*. This configuration is shown in FIG. 4E.

The tool head 42 is connected to deployment connector element 20 of carrier section 10*b*. Carrier section 10*b* is the lowered into the deployment BOP system 72 until the second deployment connector element 18 of the carrier 10*b* connects with the first deployment connector element 20 of the carrier section 10*a*. A pull test is performed to ensure connection between the carrier sections 10*a* and 10*b*. This step is illustrated in FIG. 4F.

While holding tension, the guide rams 90 are opened, tension is released, and the no-go rams 92 are opened. This step is illustrated in FIG. 4G.

Figure 4H:
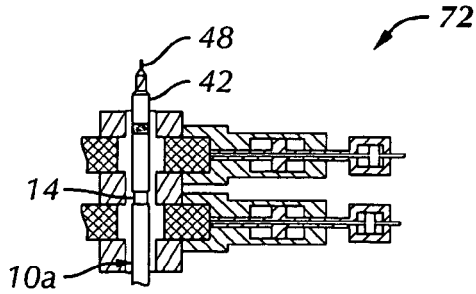
FIG. 4H shows the bailer tool string, which now comprises two carrier sections, positioned within the deployment BOP system to start the sequence to stack another carrier section.

In FIG. 4H, the bailer tool string 40, which now comprises carrier sections 10*a* and 10*b*, is lowered with the wireline and cooperating draw works so that it is positioned within the deployment BOP system 72, as illustrated previously in FIG. 4A, to stacking the sequence to stack yet another carrier section.

The process described above and illustrated in FIGS. 4A-4H can be repeated to stack additional carrier sections thereby increasing the liquid removal capacity of the bailer tool string 40. Conceptually, 1,000 feet (305 meters) of stacked carrier sections can be conveyed by a bailer tool string 40.

After the pump 62 has been activated by the pump signal, the no-return valve is opened by the valve signal, and the carrier containers of one or more carrier containers sections are filled with liquid, the bailer tool string 40 is then returned to the surface via the wireline 48 cooperating with the draw works 84. Once reaching the surface, the steps described above and illustrated in FIGS. 4A-4H are repeated in reverse, the one or more carrier sections 10*a*, 10*b*, 10*c*, etc. are removed from the bailer tool string 40, and liquid is purged from the carrier containers 12 of each carrier section 10*a*, 10*b* and 10*c*. The bailer tool string 40 can again be tripped in the borehole thereby removing as much liquid as required by a specific well operation.

It is again noted that the system is wireline operated and requires no special equipment such as coil tubing and associated coiled tubing injection systems. The system is configured to cooperate with a deployment BOP system and a wireline BOP system so that the bailer tool string 40 can be deployed, a plurality of carrier sections can be stacked in the tool string, and the tool string can be conveyed and subsequently retrieved while continuously controlling borehole pressure.

While the foregoing disclosure is directed toward the preferred embodiments of the invention, the scope of the invention is defined by the claims, which follow.

What is claimed is:

1. A system for removing liquid from a borehole, the system comprising:

(a) surface equipment sequentially generating a pump activation signal, a pump deactivation signal, and a valve signal;

(b) bailer tool string comprising (i) a tool head, (ii) at least one carrier section operationally connected to said tool head and comprising a carrier container and two cooperating deployment connector elements, (iii) an electric pump disposed within said tool head and hydraulically connected to said carrier section, and (iv) a no-return valve hydraulically connected to said carrier section; and (c) a wireline with a lower end operationally connected to said tool head and an upper end operationally connected to draw works disposed at the surface of the earth, and electrically connected to the surface equipment, wherein said electric pump activates in response to the pump activation signal and deactivates in response to the pump deactivation signal, and wherein said no-return valve opens in response to the valve signal.

2. The bailer tool string of claim 1 further comprising a plurality of axially stacked and hydraulically connected said carrier sections.

3. The bailer tool string of claim 1 further comprising a no-go shoulder on an outer surface of each of said at least one carrier section.

4. The bailer tool string of claim 1 wherein said electrical pump, upon activation by said pump activation signal, evacuates said at least one carrier section.

5. The bailer tool string of claim 1 wherein said no-return valve, upon opening by said valve signal, allows liquid to flow from said borehole into said carrier container of said at least one carrier section.

6. The system of claim 1 further comprising a deployment blow out preventer system operated to maintain pressure control within said borehole while:

(a) deploying said bailer tool string within said borehole;

(b) removing said bailer tool string from said borehole; and (c) axially stacking a plurality of said carrier sections in said bailer tool string.

7. The system of claim 1 further comprising a wireline blow out preventer system operated to allow said bailer tool string to be conveyed within said borehole by said wireline and said cooperating draw works while maintaining pressure control within said borehole.

8. A method for removing liquid from a borehole, the method comprising the steps of:

(a) disposing a bailer tool string within said liquid in said borehole, wherein said bailer tool string comprises (i) a tool head, (ii) at least one carrier section operationally connected to said tool head and comprising a carrier container and two cooperating deployment connector elements, (iii) an electric pump disposed within said tool head, and (iv) a no-return valve hydraulically connected to said carrier section;

(b) with a first electric pump signal, activating said pump thereby evacuating said at least one carrier container;

(c) with a second electric pump signal, deactivating said pump;

(d) with an electric valve signal, opening said no-return valve—after deactivating of said pump—thereby allowing said liquid to flow from said borehole into said carrier container and to be retained within said carrier container by said no-return valve; and (e) removing said bailer tool string with said retained liquid from said borehole.

9. The method of claim 8 further comprising axially stacking a plurality of hydraulically connected said carrier sections.

10. The method of claim 8 further comprising providing a wireline with a lower end operationally connected to said tool head and an upper end operationally connected to draw works disposed at the surface of the earth.

11. The method of claim 10 further comprising:

(a) providing surface equipment cooperating with said wireline through said draw works;

(b) generating said pump signal with said surface equipment and conveying said pump signal to said pump via said wireline; and (c) generating said valve signal with said surface equipment and conveying said valve signal to said no-return valve via said wireline.

12. The method of claim 11 further comprising maintaining borehole pressure control with a deployment blow out preventer system while:

(a) deploying said bailer tool string within said borehole;

(b) removing said bailer tool string from said borehole; and (c) axially stacking a plurality of said carrier sections in said bailer tool string.

13. The method of claim 12 further comprising engaging, with no-go rams of said deployment blow out preventer system, a no-go shoulder on the outer surface of each of said at least one carrier section to maintain said borehole pressure control.

14. The method of claim 10 further comprising deploying into said borehole or removing from said borehole or conveying along said borehole said bailer tool string with said wireline cooperating with said draw works.

15. The method of claim 14 further comprising controlling, with a wireline blow out preventer system, said borehole pressure while conveying said bailer tool string along said borehole.

* * * * *